US006068226A

United States Patent [19]

Anders

[11] Patent Number: 6,068,226

[45] Date of Patent: May 30, 2000

[54] DETACHABLE ANCHOR

[76] Inventor: Glen Anders, 7435 159th Pl. NE. #309, Redmond, Wash. 98052

[21] Appl. No.: 08/789,564

[22] Filed: Jan. 28, 1997

[51] Int. Cl.[7] ..... A47F 5/08

[52] U.S. Cl. ..... 248/231.91; 248/925

[58] Field of Search ..... 248/925, 231.91, 248/239, 301, 339; 411/60, 61, 55

[56] References Cited

U.S. PATENT DOCUMENTS

| | | | |
|---|---|---|---|
| 1,112,557 | 10/1914 | Read | 411/55 |
| 3,124,030 | 3/1964 | Strand | 411/60 |
| 4,194,858 | 3/1980 | Evans | 405/259 |
| 4,233,881 | 11/1980 | Carrier | 85/81 |
| 4,491,291 | 1/1985 | Ching | 248/925 |
| 4,613,264 | 9/1986 | McIntyre et al. | 411/55 |
| 4,708,552 | 11/1987 | Bustos et al. | 248/231.91 |
| 4,884,931 | 12/1989 | Revol et al. | 248/231.91 |
| 5,042,888 | 8/1991 | Shinjo | 411/54 |
| 5,263,803 | 11/1993 | Anquetin | 411/31 |
| 5,484,132 | 1/1996 | George et al. | 248/231.9 |

*Primary Examiner*—Leslie A. Braun
*Assistant Examiner*—Gwendolyn Baxter
*Attorney, Agent, or Firm*—Parsons & Goltry; Robert A. Parsons; Michael W. Goltry

[57] ABSTRACT

An anchor, comprising an anchor assembly movable between a collapsed orientation and an expanded orientation and an engagement element depending from the anchor assembly engagable by one or more selected accessories, wherein the anchor assembly is receivable into a bore in the collapsed orientation and detachably engagable to a sidewall of the bore in the expanded orientation.

9 Claims, 5 Drawing Sheets

20
72
87
50
22
107
100
121
88
106
120
130
53
73
75
70
21
71
74
3
24
76
A
B
D
E
55
37
38
101
111
105
104
104A
104B
125
122
80
32
31
30
41
51
52
33
34
35
54
56
58
23
57

FIG. 4
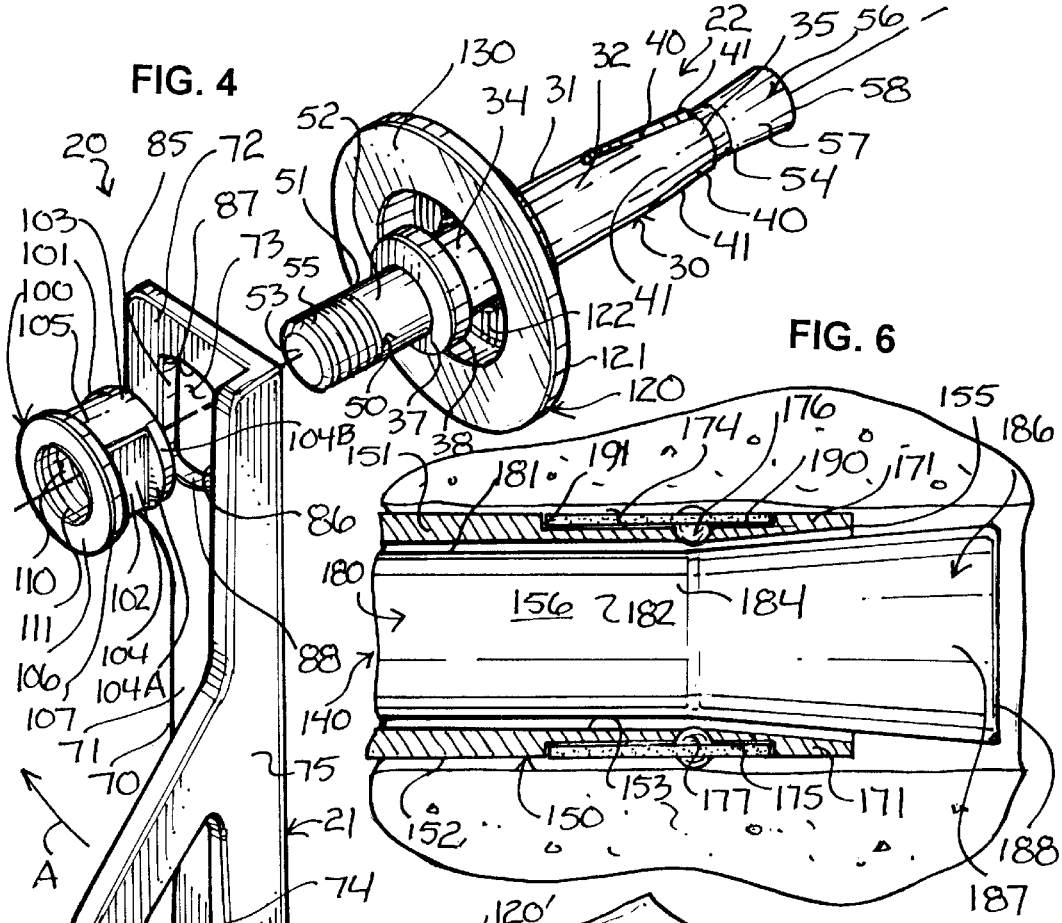
FIG. 6
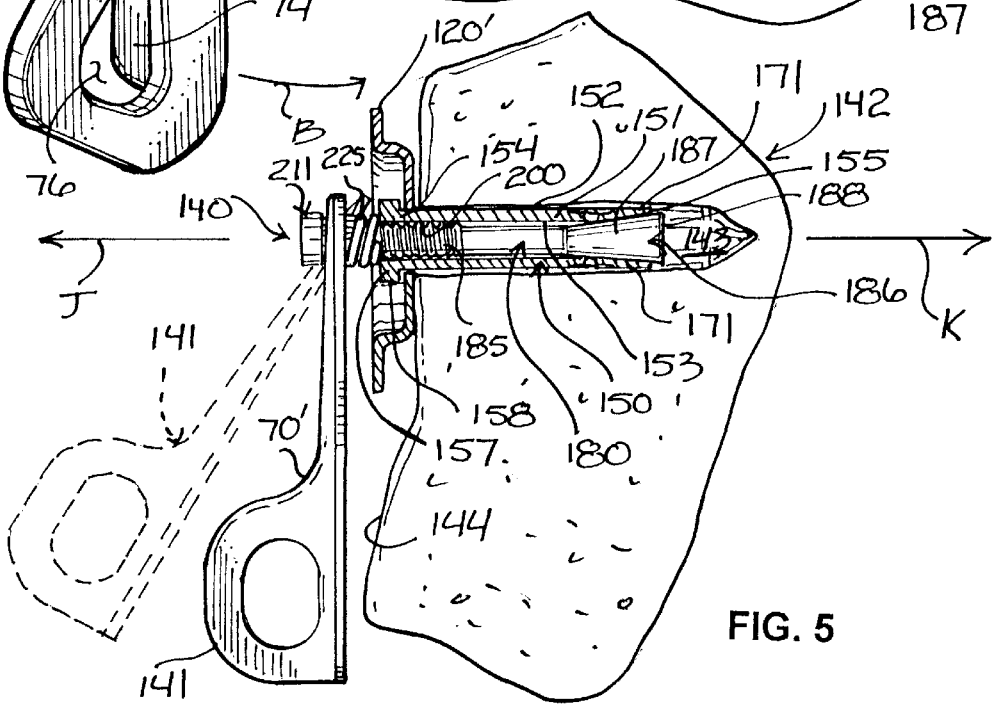
FIG. 5

140
72'
73'
213
212
216
210
185
181
182
225
180
186
187
188
184
174
142
155
176
171
170
152
154
222
183
158
150
190
191
200
151
156
157
215
214
221
220
211
75'
71'
141'
70'
76'
L
H
9
275
281
282
230
232
231
278
276
280
277
258
254
241
268
251
265
261
O
257
N
250
240
266
269
255
253

DETACHABLE ANCHOR

BACKGROUND OF THE INVENTION

1. Field of the Invention

This invention relates to anchors.

More particularly, this invention relates to rock climbing anchors for safely protecting a leader engaged to a rope from injury in the event of a fall.

In a further and more specific aspect, the instant invention relates to a removable rock climbing anchor for drilled holes formed through a rock face.

In yet a further aspect, the instant invention relates to a removable expansion bolt anchor with a built-in hanger, eye or loop for attaching carabiners that is lightweight, easy to install and easy to remove while climbing.

2. Prior Art

Rock climbing involves knowledge of rope handling. Climbers use a rope to belay, or secure, one another; one climbs while another holds the rope to protect against any fall or slip. A technique called rappelling is used in descending very steep terrain. The rope is attached in such a way that it can be pulled down after the last climber has used it; descending along the rope, the climbers use the friction thus generated (often absorbed by a mechanical device attached to their bodies) to control their rate of descent. Techniques now used for the steepest rock climbs include the use of chocks, devices that are wedged into crevices in the rock. The rope is attached to these by means of snap rings called carabiners. Vertical and overhanging rock faces may also require use of short ladderlike loops of nylon webbing, attached to the rock by the lead climbers. Following climbers can then use two mechanical ascenders that alternately grip and release the rope as the climber goes up, while standing in attached stirrups.

Rock climbing originated as a means of practicing techniques for ascending high mountains; it has evolved into a highly developed sport in itself. Although the sport does have risks, and accidents may be of catastrophic proportions, proper training and advanced techniques now ensure relative safety. Climbers often begin by taking lessons through a college group, or from one of the many local clubs in all parts of the world. Others learn from experienced friends or professional guides. Because so many of the early climbing enthusiasts were scientists or writers, or both, the field is unusually rich in descriptive literature. Current trends in climbing favor ascents made by small parties, or even solo climbers, moving very quickly with a minimum of lightweight equipment over direct routs. Summits such as Everest, previously reached only under ideal conditions, are now being successfully gained during autumn and winter months, and without the use of oxygen. Women are playing an increasingly important part in mountaineering, participating in national expeditions and organizing some of their own.

Rock climbing anchors are routinely used by both amateur and professional climbers to aid them in safely ascending and descending rock faces such high rock cliffs and mountains. These rock climbing anchors are particularly useful when the rock face includes little or no cracks or rock face irregularities climbers can use to grab onto during ascent or descent. In such a case, a hole is normally drilled through the rock face within which is placed an expansion bolt. These expansion bolts are fitted with a bolt hanger having an aperture operative for receiving portions of the expansion bolt for securing the bolt hanger to the expansion bolt, and another larger aperture to which a carabiner may be clipped. The climbing rope is attached with carabiners on a sling known as a quickdraw to those skilled in the art. These expansion bolts are permanently fixed in the rock face every ten to twenty feet along a climbing route, and are commonly referred to as fixed anchors.

Fixed anchors have been banned on most Federal and State lands where most rock climbing can be found because they are considered environmentally detrimental. In Yosemite National Park, power drilling the holes for the fixed anchors is banned to prevent proliferation. In Joshua Tree National Park, all fixed anchor bolting is banned until completion of an environmental impact study. This prevents establishing new climbing routes on rock faces without cracks.

Many existing fixed expansion bolt anchors on the thousands of rock faces in the world are thirty to forty years old. Because these fixed anchors are susceptible to corrosion, of antiquated design and not specifically designed for safe rock climbing, they are inherently unsafe and have contributed to many accidents and accidental deaths throughout the world.

In addition, on first ascents of long climbs that do not have continuous crack systems to be followed, hundreds of fixed anchors and hangers are required to be purchased at considerable expense and hauled up the rock face to be permanently fixed into the rock face. As many rock climbers know, hauling up a considerable amount of fixed anchors and hangers is not only physically difficult, but may also contribute to premature exhaustion on the part of the climber which can be dangerous for the climber.

It would be highly advantageous, therefore, to remedy the foregoing and other deficiencies inherent in the prior art.

Accordingly, it is an object of the present invention to provide a new and improved anchor detachably engagable to a bore formed through a rock face or other such face.

Another object of the present invention is to provide an anchor that is reusable.

And another object of the present invention is to provide an anchor that is safe.

Still another object of the present invention is to provide an anchor that is easy to use.

Yet another object of the instant invention is to provide an anchor that is easy to install.

Yet still another object of the instant invention is to provide an anchor that is easy to remove.

And a further object of the invention is to provide an anchor that is easy to construct.

Still a further object of the immediate invention is to provide an anchor that is environmentally friendly.

Yet a further object of the invention is the provision of limiting the costs associated with rock climbing.

And still a further object of the invention is the provision of limiting the amount of rock climbing anchors climbers need to haul with them during a climb.

Another object of the invention is the provision of limiting the number of life threatening accidents that frequently occur as a result of the use of old preexisting fixed anchors.

And another object of the invention is to provide a new and improved method for attaching an anchor to a bore formed through a rock face or other similar face.

SUMMARY OF THE INVENTION

Briefly, to achieve the desired objects of the instant invention in accordance with a preferred embodiment thereof, provided is an anchor detachably engagable to a sidewall of a bore extending inwardly through a rock face. The anchor is comprised of an anchor assembly movable between a collapsed orientation and an expanded orientation, and an engagement means depending from the anchor assembly engagable by one or more selected accessories. The anchor assembly is receivable into a bore in the collapsed orientation and detachably engagable to a sidewall defining the bore in the expanded orientation.

In a specific embodiment, the anchor assembly includes a housing movable between the collapsed orientation and the expanded orientation and an expansion means for moving the housing between the collapsed orientation and the expanded orientation. The housing includes a furcated distal end defining a plurality of forks receivable into the bore extending through the rock face, the plurality of forks movable between the collapsed orientation and the expanded orientation.

In a further embodiment, the expansion means includes a stopper carried by the housing having an expansion element movable between an extended position whereby the housing is disposed in the collapsed orientation and a retracted position whereby the expansion element engages the housing expanding the housing into the expanded orientation.

The present invention may also included is an engagement member depending from the anchor assembly and having an engagement element engagable by said one or more selected accessories. A biasing means may also be included and carried by the stopper intermediate a proximal end of the housing and a proximal end of the stopper for biasing the expansion element into the retracted position for biasing the housing into the expanded orientation to engage the bore. The biasing means may be provided as a compression spring.

A detaching member may also be included. The detaching member may be carried by the housing. The detaching member includes an inwardly extending annular flange terminating with a sidewall defining an aperture through which the housing extends, the inwardly extending annular flange interposed intermediate the rock face and an annular flange extending radially outwardly from the proximal end of the housing whereby movement of the detaching member apart from the face in response to an external force releases the housing from the expansion element of the stopper disposing the housing in the collapsed orientation thus detaching the housing from the bore.

The anchor assembly is movable between the collapsed orientation and the expanded orientation upon application of rotational force applied to the anchor assembly in one or more predetermined directions, upon application of axial force applied to the anchor assembly in one or more predetermined directions or other suitable external forces. These axial forces are provided by rotating threaded elements, by compression springs or other means.

Also provided is method of detachably engaging an anchor to a bore formed through a rock face. The method includes the steps of inserting an anchor assembly into a bore having a sidewall, engaging the anchor assembly to the sidewall, detaching the anchor assembly from the sidewall, and removing the anchor assembly from the bore. The step of engaging the anchor assembly to the sidewall further includes the step of expanding the anchor assembly, and the step of detaching the anchor assembly from the sidewall further includes the step of collapsing the anchor assembly.

BRIEF DESCRIPTION OF THE DRAWINGS

The foregoing and further and more specific objects and advantages of the instant invention will become readily apparent to those skilled in the art from the following detailed description of preferred embodiments thereof taken in conjunction with the drawings in which:

FIG. 4 is a partially exploded perspective view of the anchor of FIG. 1, in accordance with a preferred embodiment of the present invention;

FIG. 5 is a side sectional view of an anchor including a hanger depending from an anchor assembly detachably engaged to a bore formed through a rock face, in accordance with an alternate embodiment of the present invention;

FIG. 6 is an enlarged fragmented view of the anchor assembly of FIG. 5, in accordance with an alternate embodiment of the present invention;

DETAILED DESCRIPTION OF PREFERRED EMBODIMENTS

Figures 1, 2, 3:
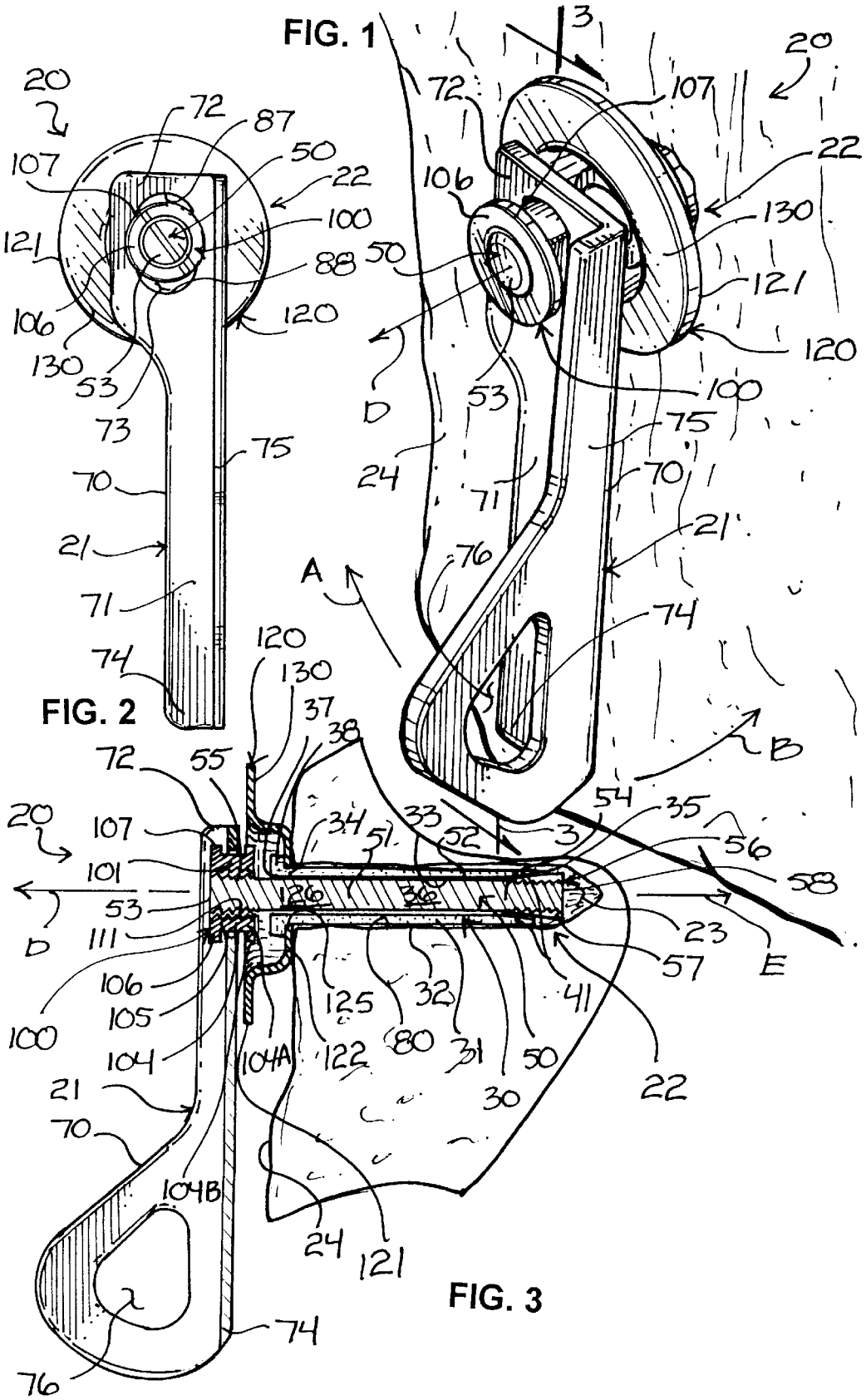
FIG. 1 is a perspective view of an anchor including a hanger depending from an anchor assembly detachably engaged to a bore formed through a rock face, in accordance with a preferred embodiment of the present invention.
FIG. 2 is a front elevational view of the anchor of FIG. 1, in accordance with a preferred embodiment of the present invention.
FIG. 3 is a sectional view taken along line 3—3 of FIG. 1, in accordance with a preferred embodiment of the present invention.

Turning now to the drawings, in which like reference characters indicate corresponding elements throughout the several views, attention is first directed to FIG. 1 which illustrates a perspective view of an anchor 20 including a hanger 21 depending from an anchor assembly 22 detachably engaged to a bore 23 (seen in FIG. 2 but not shown in FIG. 1) formed through a rock face 24, in accordance with a preferred embodiment of the present invention. Anchor 20 is operative as a rock climbing anchor suitable for receipt within and detachable engagement to bore 23 being either preexisting or drilled into and through rock face 24 by means of a hand impact drill, a motorized drill or other apparatus suitable for forming or otherwise excavating bore 23 into and through rock face 24. When engaged within bore 23 formed through rock face 24, rock climbers may then enlist the use of anchor 20 for aiding them in safely ascending and descending rock face 24 which may form part of a mountain, a cliff, or other selected rock face desired to be safely and efficiently traversed without having to leave anchor 20 behind in a manner and for reasons presently to appear. It will readily occur to those having ordinary skill that anchor 20 may be useful in other applications besides rock climbing, the scope and breadth of which are intended to be included herein.

Attention is now directed to FIG. 3 illustrating a sectional view taken along line 3—3 of FIG. 1, and FIG. 4 illustrating a partially exploded perspective view of anchor 20 of FIG. 1, in accordance with a preferred embodiment of the present invention. Preferably constructed of steel, aluminum, titanium or other substantially rigid material having similar structural and functional characteristics, anchor assembly 22 is generally comprised of a housing 30 including an elongate continuous sidewall 31 having a continuous outer surface 32 defining an outer diameter, a continuous inner surface 33 defining an inner diameter, a proximal end 34 and a distal end 35. Proximal end 34 and distal end 35 are both open and communicate a bore 36 extending therebetween defined by continuous inner surface 33. Inner surface 33 proximate distal end 35 is conically tapered toward distal end 35. An annular flange 37 extends radially outwardly from proximal end 34 of housing 30 and terminates with a continuous endwall 38 defining a diameter somewhat greater than the outer diameter defined by continuous outer surface 32. Distal end 35 is divided or furcated by means of one or more slots 40 extending inwardly and longitudinally along elongate continuous sidewall 31 from distal end 35 thereby defining a plurality of forks 41. As can be seen in FIG. 4, each one of said plurality of forks 41 taper somewhat radially inwardly.

Anchor assembly 22 further includes a stopper 50 carried within bore 36 of housing 30. Stopper 50 includes an elongate body 51 having a continuous outer surface 52 defining an outer diameter somewhat less than the inner diameter of housing 30, a proximal end 53 extending somewhat beyond proximal end 34 of housing 30 and a distal end 54 extending somewhat beyond distal end 35 of housing 30. A threaded engagement element 55 is carried by and formed into elongate body 51 proximate proximal end 53 and an expansion element 56 is carried by and extends outwardly from distal end 54, details to be presently discussed. Expansion element 56 is a preferred expansion means and is provided as an outwardly conical member 57 terminating with a continuous outer edge 58 defining an outer expansion element diameter somewhat greater that the inner diameter of housing 30 as defined by continuous inner surface 33.

Although hanger 21 may be of any preferred form, hanger 21 is generally comprised of a body 70 having a substantially elongate configuration. Preferably fabricated of steel, composite aluminum, titanium or substantially rigid material having similar structural and functional characteristics, body 70 includes a base plate 71 having an inner end 72 with an aperture 73 formed therethrough, an outer end 74 and a sidewall 75 extending laterally therefrom along substantially the entire length of base plate 71, although this is not essential. Sidewall 75 is enlarged toward outer end 74 of base plate 71 and includes an aperture 76 formed therethrough to receive carabiners, quickdraws, ropes or the like. Aperture 76 defines what is considered to be a closed or boxed receptacle or end of body 70 suitable for engagement by carabiners, quickdraws, ropes, etc., for safe climbing.

As previously indicated, anchor 20 is useful by both amateur and professional climbers to aid them in safely ascending and descending rock faces such high rock cliffs, mountains, artificial structures or other obstacles desired to be traversed. In particular, when a climber wishes to use anchor 20 when ascending a rock face, such as rock face 24 in FIG. 1 and FIG. 2, bore 23 must first be drilled through rock face 24 as previously discussed. However, bore 23 may be preexisting. Nevertheless, once bore 23 is provided or formed, a climber may then proceed to engage anchor 20 to bore 23.

To carry out this procedure, housing 30 having stopper 50 carried therein is first inserted into bore 23 such that distal end 35 of housing 30 and expansion element of stopper 50 extend into bore 23. For the purposes of discussion, bore 23 is defined by a continuous sidewall 80 defining an inner diameter and is preferably formed having a sufficient depth to receive substantially the entire length of not only housing 30 but also stopper 50. In addition, it is also preferred that the inner diameter of bore 23 be somewhat larger that the outer diameter of housing 30 and the outer expansion element diameter defined by continuous outer edge 58 of stopper 50 in order to ensure that housing 30 and stopper 50 may be easily inserted into bore 23.

It will be duly noted that the diameter defined by continuous endwall 38 of flange 37 extending radially outwardly from proximal end 34 of housing 30 is preferably somewhat larger than the inner diameter of bore 23 as defined by continuous sidewall 80 as to prevent housing 30 from being lost into bore 23 when inserted therein and for additional reasons presently to appear. However, it will be generally understood that when properly placed within bore 23, distal end 35 of housing 30 and expansion element 56 of stopper 50 extend inwardly into bore 23, flange 37 rests proximate rock face 24 and proximal end 53 of stopper extends somewhat outwardly from proximal end 34 of housing 30.

Upon insertion of anchor assembly 22 into bore 23, hanger 21 may then be coupled thereto. With continuing reference to FIG. 2, FIG. 3 and FIG. 4, to carry out this procedure distal end 53 of stopper 50 is received through aperture 73 formed through inner end 72 of hanger 21. The diameter of aperture 73 is preferably considerably larger than the outer diameter of stopper 50. Furthermore, aperture 73 is somewhat elongate and is defined by a pair of spaced-apart parallel upstanding sidewalls, 85 and 86, an upper arcuate sidewall 87 and a lower arcuate sidewall 88. To secure hanger 21 to stopper 50, provided is a key 100 having a body 101 defined by a pair of spaced-apart parallel upstanding sidewalls, 102 (only one shown), an arcuate upper surface 103, an arcuate lower surface (not shown), an outer end 104 having an annular flange 104A extending radially outwardly therefrom and terminating with an outer endwall 104B defining a diameter, and an inner end 105 having an annular flange 106 extending radially outwardly therefrom and terminating with an outer endwall 107 defining a diameter. With momentary reference to FIG. 2, it can be seen that the diameter defined by outer endwall 107 and outer endwall 104B is somewhat greater than the diameter of aperture 73.

Body 101 is sized for specific receipt into and is to be forced through aperture 73 and includes a shape that conforms substantially to the shape of aperture 73 such that when received by aperture 73, key 100 will not rotate therein and is thus carried by aperture 73 in a rotationally static orientation as an assembly. In this manner, hanger 21 is retained upon key 100 and will not come off during use. Furthermore, body 101 includes a bore 110 extending therethrough defined by a threaded inner wall 111 extending from inner end 105 to outer end 104. Threaded inner wall 111 is threadably and detachably engagable to threaded engagement element 55 carried by stopper 50 proximate proximal end 53 thereof upon rotation of key 100 in a predetermined rotational direction operative for detachably engaging hanger 21 proximate proximal end 53 of stopper 50 with hanger 21 depending from key 100, of which can clearly be seen in FIG. 1 and FIG. 2 and FIG. 3. To rotate key 100, hanger 21 may be grasp by a user and rotated laterally in the direction indicated by the arcuate arrowed line A in FIG. 1 and FIG. 4 for threadably engaging key 100 to threaded engagement element 55, and also rotated laterally in the direction indicated by the arcuate arrowed line B in FIG. 1 and FIG. 4 for threadably detaching key from threaded engagement element 55, although this is not essential and these rotational directions may be reversed.

It will be understood from the foregoing discussion that body 101 of key 100 and aperture 73 of hanger 21 are of respective corresponding size and shape such that when received one by the other, rotational movement of body 101 relative aperture 73 is not possible. It will further be understood by those having ordinary skill that key 100 and aperture 73 may be formed having a variety of size and shape orientations suitable for carrying out this aspect of the instant invention of which are intended to be included within the breadth and scope of the instant invention as herein specifically disclosed. In addition, threaded engagement element 55 and threaded inner wall 110 are herein defined as an engagement element and a complemental engagement element, respectively, of an engagement pair operative for detachably engaging key 100 to stopper 50 proximate proximal end 53 thereof. Although disclosed as the preferred means of engaging key 100 to stopper 50 and for securing hanger to stopper 50, other suitable engagement means may be used and are intended to be included within the breadth and scope of the instant invention as herein specifically disclosed. Furthermore, key 100 may be made as an integral part of stopper 50, eliminating the threaded complementary surfaces with the assembly remaining unchanged.

Upon engagement of hanger 21 and key 100 to stopper 50, one may then proceed to detachably engage anchor assembly 22 to bore 23. In particular, and with reference to FIG. 1 and FIG. 3, rotation of key 100 by hanger 21 in the direction indicated by arcuate arrowed line A will operate to threadably urge proximal end 53 of stopper through key 100 and outwardly from bore 23 in the direction indicated by the arrowed line D in FIG. 1 and FIG. 3. With continued rotation of key 100 by hanger 21 in the direction of arcuate arrowed line A, stopper 50 will continue to move outwardly in the direction indicated by arrowed line D causing expansion element 56 to receive and impinge upon plurality of forks 41 of distal end 35 of housing 30 urging plurality of forks 41 radially outwardly impinging continuous sidewall 80 of bore 23 as stopper 50 is continually urged outwardly in the direction of arrowed line D. As a result, plurality of forks 41 of housing become detachably and securably engaged to continuous sidewall 80 of bore 23 as clearly shown in FIG. 3.

By virtue of the instant discussion, it will be readily understood that housing 30 is movable between a collapsed orientation (FIG. 4) whereby plurality of forks 41 are tapered somewhat radially inwardly thus allowing a user to easily insert anchor assembly into bore 23, and an expanded orientation (FIG. 3) whereby plurality of forks 41 are disposed radially outwardly upon movement of stopper 50 outwardly in the direction indicated by arrowed line D such that expansion element 56 engages plurality of forks 41 thereby urging them radially outwardly in an expanded orientation for secure and detachable engagement to continuous sidewall 80 of bore 23. Because the outer expansion element diameter defined by continuous outer edge 58 of expansion element 56 is somewhat greater that the inner diameter of housing 30, expansion element 56 is prevented from passing inwardly through bore 36 past distal end 35 of housing 30, although this is not essential. Aperture 76 of hanger 21 can then be used for receiving a carabiner (not shown) to which a climbing rope (not shown) can be attached for safely securing a climber to rock face 24 such that in the event of a fall, anchor 20 would prevent the climber from falling to the ground.

Although the external force applied to stopper 50 operative for urging stopper outwardly in the direction indicated by arrowed line D for detachably securing housing 30 to continuous sidewall 80 of bore 23 has been herein specifically described as rotational force applied to key 100, it will be understood by those having ordinary skill that other means of external force such as direct axial force and other means of external force not herein specifically addressed can be exerted upon stopper 50 for urging stopper 50 outwardly in the direction indicated by arrowed line D, all of which are intended to be included herein. Additionally, although stopper 50 has been herein disclosed as the preferred means of disposing housing between the collapsed orientation and the expanded orientation, other means may be used without departing from the nature and scope of the instant invention and are also intended to be included within the breadth and scope of the instant invention.

To detach anchor 20 from bore 23, external force need only be applied to stopper 50 for urging stopper 50 inwardly into bore 23 in the direction indicated by the arrowed line E in FIG. 3 to disengage expansion element 56 from plurality of forks 41 thereby causing plurality of forks 41 to assume the collapsed orientation thus disengaging plurality of forks 41 from continuous sidewall 80 of bore 23. After housing is detached from continuous sidewall 80 of bore 23, it may be easily removed and reused. Consistent with the foregoing discussion, it will understood that stopper 50 may be urged inwardly into bore 23 through rotation of key 100 in the direction of arcuate arrowed line B, of which may be rotated through application of corresponding force to hanger 21.

Alternatively, and with continuing reference to FIG. 1, FIG. 3 and FIG. 4, a detaching member 120 may be provided as part of anchor assembly 22 allowing a user to urge housing 30 outwardly in the direction of arrowed line D to disengage plurality of forks 41 from expansion element 56 thereby causing plurality of forks 41 to assume the collapsed orientation thus disengaging plurality of forks 41 from continuous sidewall 80 of bore 23. As shown in FIG. 3, detaching member 120 includes a body 121 formed generally in the shape of a bowl or hat. Body 121 is carried by housing 30 and includes an inwardly extending annular flange 122 terminating with a sidewall 125 defining an aperture 126 through which housing 30 extends. Inwardly extending annular flange 122 is interposed intermediate rock face 24 and flange 37 of housing 30. Body 121 further includes an outwardly extending annular flange 130 that a user may grasp and urge outwardly in the direction of arrowed line D upon application of an external force thereby moving detaching member 120 apart from rock face 24 and releasing plurality of forks 41 from expansion element 56 disposing housing 30 in the collapsed orientation thus detaching housing 30 from continuous sidewall 80 of bore 23. When anchor assembly 22 is fastened to bore 23 as shown in FIG. 3, body 121 of detaching member 120 normally abuts rock face 24 and extends outwardly supporting flange 130 at a location spaced from rock face 24 defining a space between flange 130 and rock face 24. The importance of having flange 130 supported spaced from the rock face 24 is evident as it allows a user to position his or her fingers into the space between the rock face 24 and flange 130 for grasping flange 130. If flange 130 normally rested against the rock face 24, it would be impossible for a user to grasp. Consistent with this disclosure, flange 130 comprises, and functions as, a grip.

Anchor 20 need not be disassembled prior to engagement to bore 23, and otherwise may be totally assembled and carried by a user for quick and easy use. In addition, hanger 21 may be fixedly engaged proximate proximal end 53 of stopper 50 if desired, or integral with proximal end 53 of stopper 50 without hindering the use of anchor 20, both alternatives of which are intended to be included within the general scope of the instant invention as herein specifically disclosed. In additional, although the furcated nature of housing 30 has been herein disclosed as the preferred means by which housing may be disposed between a collapsed orientation and an expanded orientation, it will be readily appreciated by those having ordinary skill that housing 30 may be constructed in a variety of ways not herein discussed operative for facilitating movement thereof between a collapsed orientation and an expanded orientation with the use of stopper 50 as previously discussed, all of which are intended to be included within the nature and scope of the instant invention as herein specifically disclosed.

Figures 7, 8, 9:
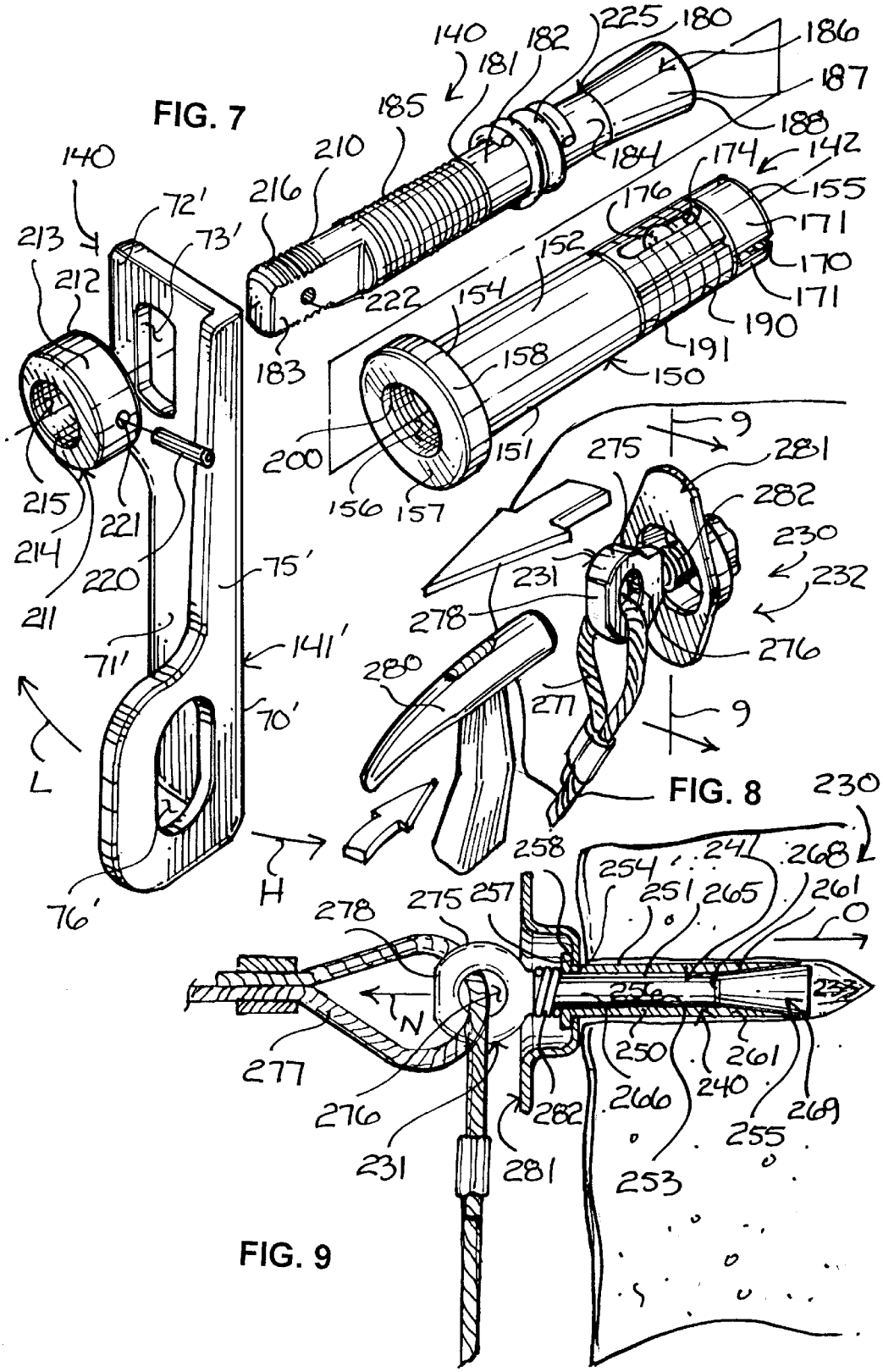
FIG. 7 is a partially exploded perspective view of the anchor of FIG. 5, in accordance with an alternate embodiment of the present invention.
FIG. 8 is a perspective view of an anchor including a hanger depending from an anchor assembly detachably engaged to a bore formed through a rock face, in accordance with another alternate embodiment of the present invention.
FIG. 9 is a side sectional view of an anchor taken along line 9—9 of FIG. 8, in accordance with another alternate embodiment of the present invention.

Attention is now directed to FIG. 5, illustrating a side sectional view of an anchor 140 including a hanger 141 depending from an anchor assembly 142 detachably engaged to a bore 143 formed through a rock face 144, and FIG. 6 illustrating a partially exploded perspective view of anchor 140 of FIG. 5, in accordance with an alternate embodiment of the present invention. Having generally the same structural components and functional characteristics as anchor 20, anchor 140 includes a housing 150 including an elongate continuous sidewall 151 having a continuous outer surface 152 defining an outer diameter, a continuous inner surface 153 defining an inner diameter, a proximal end 154 and a distal end 155. Proximal end 154 and distal end 155 are both open and communicate a bore 156 extending therebetween defined by continuous inner surface 153 (FIG. 5). An annular flange 157 extends radially outwardly from proximal end 154 of housing 150 and terminates with a continuous endwall 158 defining a diameter somewhat greater than the outer diameter defined by continuous outer surface 152. Distal end 155 is divided or furcated by means of one or more slots 170 (only one shown) extending inwardly and longitudinally along elongate continuous sidewall 151 from distal end 155 thereby defining a plurality of forks 171. As shown in FIG. 7 and FIG. 6, a pair of longitudinally disposed elongate apertures, 174 and 175, formed through continuous sidewall 151 proximate distal end 155 each house one of a pair of bearings, 176 and 177, respectively, details of which will be discussed as the detailed description ensues.

Like anchor assembly 22, anchor assembly 142 further includes a stopper 180 carried within bore 156 of housing 150. Stopper 180 includes an elongate body 181 having a continuous outer surface 182 defining an outer diameter somewhat less than the inner diameter of housing 150, a proximal end 183 extending somewhat beyond proximal end 154 of housing 150 and a distal end 184 extending somewhat beyond distal end 155 of housing 150. A threaded engagement element 185 is carried by and formed into elongate body 181 intermediate proximal end 183 and distal end 184 and an expansion element 186 is carried by and extends outwardly from distal end 184 very much similar to expansion element 56 previously discussed in combination with anchor 20. Expansion element 186 is provided as an outwardly conical member 187 terminating with a continuous outer edge 188 defining an outer expansion element diameter somewhat greater that the inner diameter of housing 150. Detaching member 120', substantially similar to detaching member 120 discussed previously, may also be provided in combination with anchor assembly 142, although this is not essential.

Hanger 141 is substantially identical to hanger 21 discussed previously in combination with anchor 20 and includes substantially the same structural features. Accordingly, the same reference characters used to describe hanger 21 will also be used to describe hanger 141. However, respecting the interests of clarity, the same reference characters used to describe hanger 21 and hanger 141 will be indicated with a prime ("'") symbol in combination with hanger 141. Accordingly, like hanger 21, hanger 141 includes a body 70' having a base plate 71' with an inner end 72' having an aperture 73' formed therethrough, an outer end 74' and a sidewall 75' extending laterally therefrom along substantially the entire length of base plate 71', although this is not essential. Sidewall 75' is enlarged toward outer end 74' of base plate 71' and includes an aperture 76' formed therethrough.

Anchor assembly 142 may be detachably engaged to and correspondingly removed from bore 143 in much the same manner as anchor assembly 22, details of which will not be again specifically addressed as they will be readily understood. However, upon insertion of anchor assembly 142 into bore 143, hanger 141 may then be coupled thereto in a manner specific to anchor 140. In particular, with continuing reference to FIG. 7 distal end 183 of stopper 180 is received through aperture 73' formed through inner end 72' of hanger 141. Distal end 183 is comprised of a key 210 formed having a shape that conforms substantially to the shape of aperture 73' such that when received through aperture 73', key 210 will not rotate therein and is thus carried by aperture 73' in a rotationally static orientation much like the way key 100 is received within aperture 73 previously discussed. It will be understood by those having ordinary skill that key 210 and aperture 73' may be formed having a variety of size and shape orientations suitable for carrying out this aspect of the instant invention of which are intended to be included within the breadth and scope of the instant invention as herein specifically disclosed.

To secure hanger 141 to stopper 180, provided is a nut 211 having a continuous sidewall 212 with a continuous outer surface 213 defining a diameter somewhat greater than the diameter of aperture 73' and a continuous threaded inner surface 214 defining a bore 215 extending therethrough. Upon receipt of key 210 through aperture 73', nut 211 may be threadably and detachably engaged thereto upon rotational movement of nut 211 relative key 210 in a predetermined direction for detachably retaining hanger 141 to stopper 180 proximate proximal end 183 thereof. In particular, threaded inner surface 214 is threadably and detachably engagable to a threaded engagement element 216 formed into stopper 180 proximate distal end 183 thereof in a manner well known to those having ordinary skill. Upon the threaded engagement of nut 211 to distal end 183, a rolled or split pin 220 may be inserted into a bore 221 formed through continuous sidewall 212 of nut 211 for ultimate receipt into a corresponding bore 222 formed through key 210 proximate proximal end 183 thereby detachably and securingly engaging nut 211 to key 210 proximate distal end 183. To detach nut 211 from distal end 183, the above operation need only be reversed. It will be understood that continuous outer surface 213 may be provided having a hexagonal configuration or other irregular configuration suitable to be easily grasp by a conventional wrench or the like.

Threaded engagement element 216 and threaded inner surface 214 are herein defined as an engagement element and a complemental engagement element, respectively, of an engagement pair operative for detachably engaging nut 211 to key 210, although other engagement means may be used and are intended to be included within the breadth and scope of the instant invention as herein specifically disclosed. Furthermore, nut 211 may be made integral to stopper 180 either from being originally formed as if assembled by threaded engagement or by welding instead of threaded engagement.

Unlike anchor assembly 22, when stopper 180 is housed within housing 150, threaded engagement element 185 is threadably and detachably engaged to a threaded engagement element 200 formed in continuous inner surface 153 of continuous sidewall 151 of which can clearly be seen in FIG. 5. Upon attaching hanger 141 to stopper 180 in a manner previously discussed, a user may then grasp and rotate hanger 141 laterally in the direction indicated by the arcuate arrowed line H in FIG. 7 thus imparting rotational movement to stopper 180 causing stopper to urge outwardly from bore 143 in the direction indicated by the arrowed line J in FIG. 5. As stopper 180 is urged outwardly in the direction indicated by the arrowed line J, expansion element 186 impinges upon plurality of forks 171 disposing them into an expanded orientation thereby detachably engaging plurality of forks 171 of housing 150 to bore 143. In similar fashion, rotation of hanger 141 laterally in the direction indicated by the arcuate arrowed line L in FIG. 7 thus imparting rotational movement to stopper 180 in an opposing direction causes stopper to urge inwardly into bore 143 in the direction indicated by the arrowed line K in FIG. 5. As stopper 180 is urged inwardly in the direction indicated by the arrowed line K, expansion element 186 detaches from plurality of forks 171 disposing them into a collapsed orientation detaching housing 150 from bore 143. Alternatively, to provide greater holding strength than the furcated plurality of forks alone, bearings 176 and 177 carried within apertures 174 and 175, respectively, run along continuous outer surface 182 of stopper 180 as stopper 180 moves within housing 150. Bearings 176 and 177 may further be retained to housing 150 by a rolled split ring 190 carried by housing 150 within a groove 191 formed into surface 152.

As can be seen in FIG. 5, a compression spring 225 may be provided and is shown carried by stopper 180 intermediate inner end 72' of hanger 141 and annular flange 157 of housing 150. Compression spring 225 bears against annular flange 157 and inner end 72' of hanger 141 and is operative as a biasing means for biasing inner end 72' of hanger 141 in spaced-apart relation relative proximal end 154 of housing 150, although other biasing means may be used. Compression spring 225 may be helical or a leaf spring and serves to bring stopper 180 along J to the expanded orientation. A force applied in direction K would return the anchor to the contracted orientation. Furthermore, the biasing means also operates to maintain hanger 141 in an operative orientation and further allows hanger 141 to pivot outwardly when necessary under load or during installation into or removal from bore 143 as indicated by the dotted outline of hanger 141 in FIG. 5.

Like anchor 20, anchor 140 need not be disassembled prior to engagement to bore 143, and thus may be totally assembled and carried by a user for quick and easy use. In addition, hanger 141 may be fixedly engaged proximate proximal end 183 of stopper 180 if desired, or integral with proximal end 183 without hindering the use of anchor 140, both alternatives of which are intended to be included within the general scope of the instant invention as herein specifically disclosed.

Figure 10:
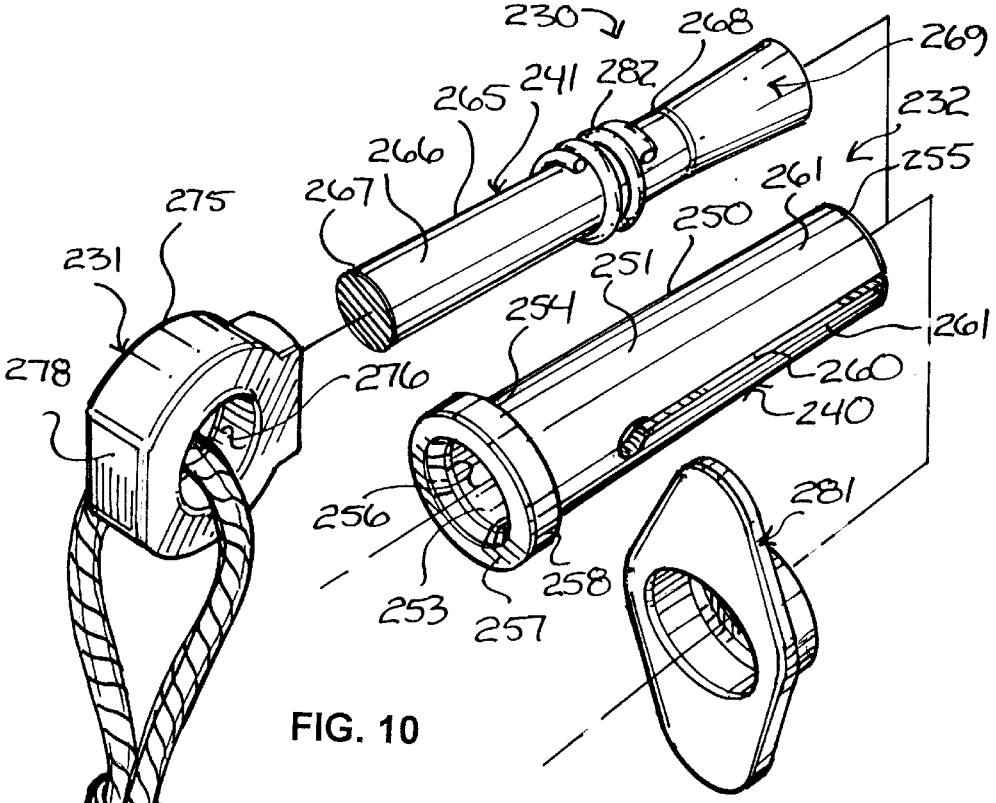
FIG. 10 is an exploded perspective view of the anchor of FIG. 8, in accordance with another alternate embodiment of the present invention.

Attention is now directed to FIG. 8 illustrating a perspective view of an anchor 230 including a hanger 231 depending from an anchor assembly 232 detachably engaged to a bore 233 (FIG. 9) formed through a rock face 234, in accordance with another alternate embodiment of the present invention. With additional reference to FIG. 9 illustrating a side sectional view of anchor 230 taken along line 9—9 of FIG. 8 and FIG. 10 illustrating an exploded perspective view of anchor 230, anchor assembly 232 is generally comprised of a housing 240 and a stopper 241 having similar structural and functional characteristics as housing 30 and stopper 50 discussed previously in combination with anchor 20. Housing 240 is generally comprised of a continuous sidewall 250 having a continuous outer surface 251, a continuous inner surface 253, a proximal end 254 and a distal end 255 both of which are open and communicate a bore 256 extending therebetween defined by continuous inner surface 253. An annular flange 257 is also provided and extends radially outwardly from proximal end 254 of housing 240 and terminates with a continuous endwall 258. Housing 240 is divided or furcated by means of one or more slots 260 extending inwardly and longitudinally along continuous sidewall 250 from distal end 255 defining a plurality of forks 261.

Stopper 241 is carried within bore 256 of housing 240 and includes an elongate body 265 having a continuous outer surface 266, a proximal end 267 extending somewhat beyond proximal end 254 of housing 240 and a distal end 268 extending somewhat beyond distal end 255 of housing 240. Stopper further includes an expansion element 269 carried by and extending outwardly from distal end 268 very much similar to expansion element 56 previously discussed in combination with anchor 20 and expansion element 186 previously discussed in combination with anchor 140.

Hanger 231 is comprised of an eye bolt 275 preferably integrally coupled to proximal end 267 of stopper 241, although this is not essential. Eye bolt 275 includes an impact surface 278 and an aperture 276 to which a carabiner or other link such as rope 277 may be secured, details of which will be discussed as the detailed description ensues.

The installation and removal of anchor assembly 232 to and from bore 233 is carried out in a manner similar to the manner previously discussed in combination with anchor assembly 22 and anchor assembly 142. Accordingly, the specific details of the installation and removal of anchor assembly 232 will not be herein specifically addressed as they will be readily understood from the foregoing discussions. However, to secure housing 240 to bore 233, a compression spring 282, similar to compression spring 225, serves to bring stopper 241 into the expanded position to dispose housing 240 into the expanded orientation to engage bore 233. Furthermore, a user may also grasp eye bolt 275 or grasp rope 277 or other link coupled to eye bolt 275 and apply an axial external force in the direction indicated by the arrowed line N in FIG. 9 thereby urging stopper 241 outwardly from bore 233 thereby disposing housing 240 into an expanded orientation thus engaging housing 240 to bore 233. In corresponding fashion, to detach housing 240 from bore 233, a user need only apply an axial compressive force upon stopper 241 in the direction indicated by the arrowed line O in FIG. 9 thereby urging stopper 241 inwardly into bore 233 thereby disposing housing into a collapsed orientation and thus detaching housing 240 from bore 233. To apply compressive force to stopper 241, a user may strike impact surface 278 with a hammer 280 (FIG. 8) or other suitable instrument. Alternatively, anchor assembly 232 may be provided with a detaching member 281 operative for detaching housing 240 from expansion element 269 thereby disposing housing into the collapsed orientation thus releasing housing from bore 233. Detaching member 281 includes substantially the same structural elements and operates in much the same manner as detaching member 120. Accordingly, the specific structural aspects of detaching member 281 will not be herein specifically addressed as they will be readily understood pursuant to the foregoing discussion concerning detaching member 120.

Figure 11:
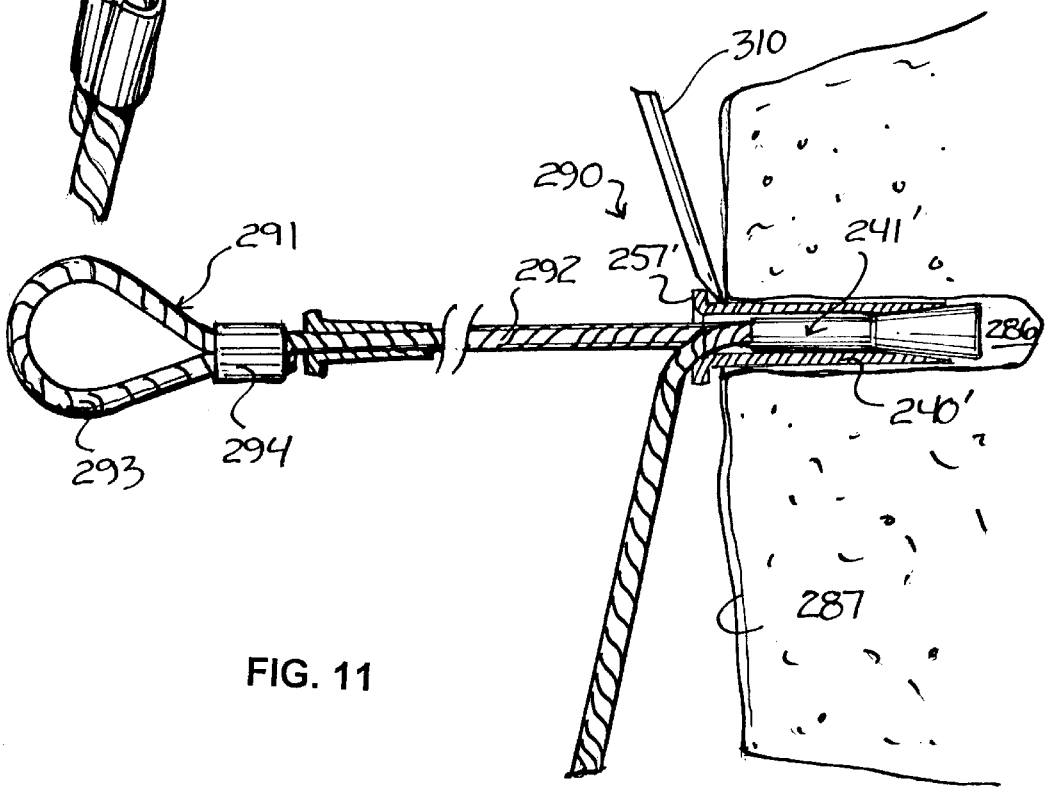
FIG. 11 is a side sectional view of an anchor including a hanger depending from an anchor assembly detachably engaged to a bore formed through a rock face, in accordance with yet another alternate embodiment of the present invention.

With attention directed to FIG. 11, illustrated is a side sectional view of an anchor 290 including a hanger 291 depending from an anchor assembly 292 detachably engaged to a bore 286 formed through a rock face 287, in accordance with yet another alternate embodiment of the present invention. Anchor 290 includes substantially the same structural elements as anchor 230. Therefore, the same reference characters used to describe anchor 230 will also be used in the brief description of anchor 290. However, to facilitate clarity of discussion, common reference characters used to describe both anchor 230 and 290 will be denoted with a prime ("') symbol throughout the discussion of anchor 290.

Figure 12:
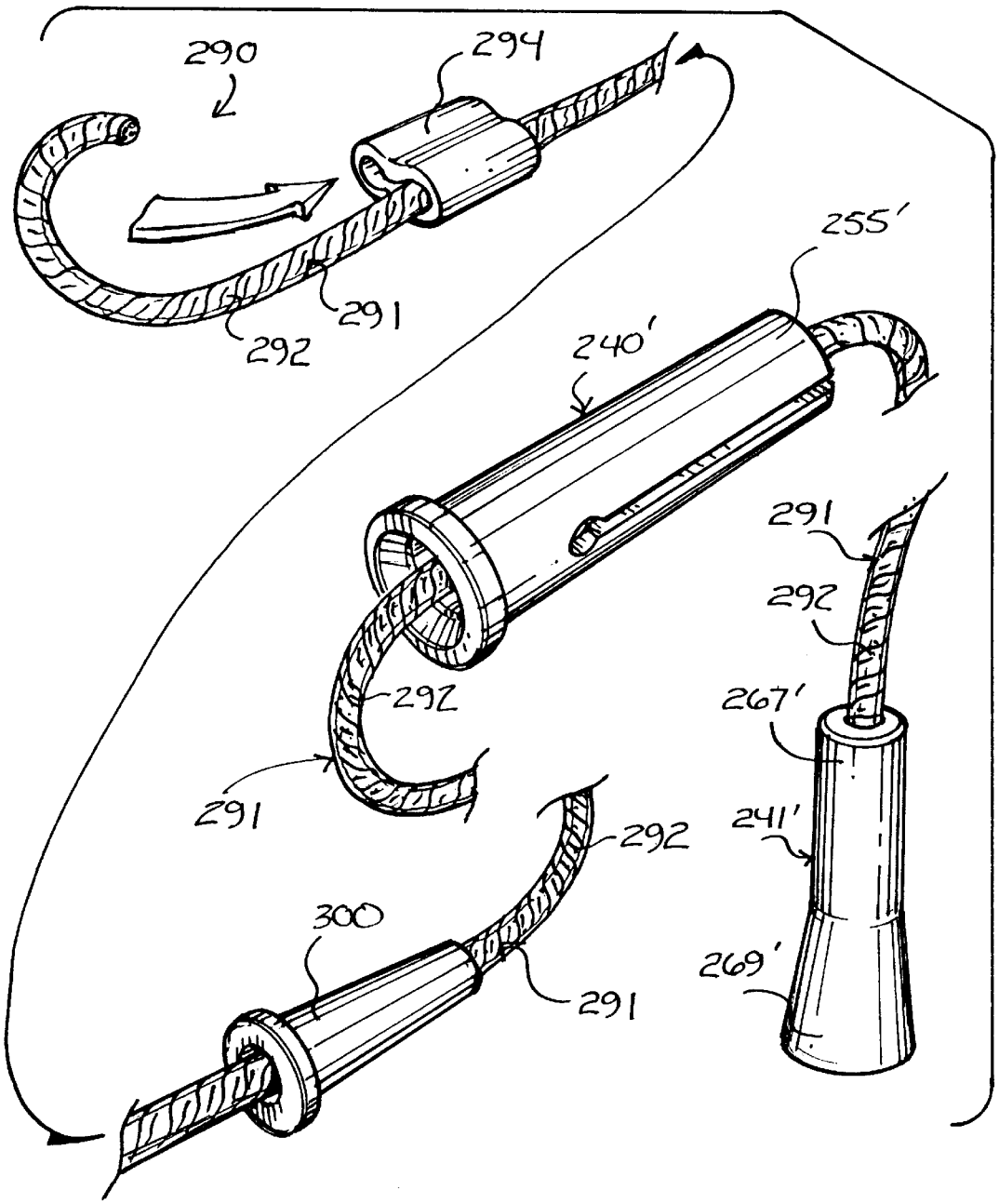
FIG. 12 is a fragmented exploded perspective view of the anchor of FIG. 11, in accordance with yet another alternate embodiment of the present invention.

Accordingly, and with additional reference to FIG. 12 illustrating a fragmented exploded perspective view of anchor 290 of FIG. 11, anchor 290 includes housing 240' and stopper 241'. However, unlike anchor 230, anchor 290 includes a hanger 291 provided in the form of a lanyard 292 fixedly coupled to proximal end 267' of stopper 241' and extending outwardly therefrom and terminating with a loop 293 formed with the aid of a ferrule 294. Although lanyard 292 may be constructed of any suitable material such as nylon, perlon or other similarly strong fabric-like substance, lanyard 292 is preferably constructed of steel cable welded to proximal end 267' of stopper 241' operative for forming a rigid and highly resilient connection. A remover bushing 300 slidably coupled intermediate ferrule 294 and proximal end 267' of stopper 241 is also provided. After housing 240' has become detachably engaged to bore 286, remover bushing 300 may be slid down lanyard 292 toward proximal end 267' of stopper 241' and then tapped against proximal end 267' for pushing expansion element 269' out of distal end 255' of housing 240' thereby disposing housing 240' in the collapsed orientation for facilitating the easy removal of anchor 290 from bore 286. Alternatively, as can be seen in FIG. 11 a user may use an instrument such as a cleaning tool 310 or the like to apply axial force to housing 240' in order to force housing 240' outwardly from bore 286. In particular by placing the tip of cleaning tool 310 between rock face 287 and annular flange 257' and then prying or otherwise urging housing 240' outwardly from bore 286, housing 240' becomes detached from expansion element 269' thereby disposing housing 240' into the collapsed orientation. Alternatively, a detaching member similar to detaching member 181 may be used in a manner consistent herewith.

It will be readily appreciated by those having ordinary skill that a plurality of highly efficient and useful anchors have disclosed. Each are both easily engaged to a bore extending through a rock face and easily removed therefrom when use is no longer needed. They are easy to use, simple to construct and safe. It will be readily understood that each of the foregoing embodiments may be assembled prior to use to facilitate ease of use. Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. An anchor engagable to a sidewall of a bore extending inwardly through a face, comprising:

an anchor assembly including:

a housing movable between a collapsed orientation and an expanded orientation and a stopper carried by said housing and having an expansion element movable between an extended position disposing said housing in said collapsed orientation and a retracted position disposing said housing in said expanded orientation, and biasing means carried by said stopper intermediate a proximal end of said housing and a proximal end of said stopper for biasing said expansion element to said retracted position;

a hanger depending from said anchor assembly terminating with a boxed end engagable by one or more selected accessories, wherein said anchor assembly is receivable into the bore in said collapsed orientation and detachably engagable to the sidewall of said bore in said expanded orientation; and a detaching member carried by said housing, said detaching member including a body having a grip that with said anchor assembly engaged with said sidewall of said bore in said expanded orientation, said body of said detaching member adapted to abut said face and supports said grip at a location adapted to be spaced from said face, wherein said grip is capable of being grasped and moved away from said face in response to an external force to release said housing from said expansion element of said stopper disposing said housing in said collapsed orientation detaching said housing from said bore.

2. The anchor of claim 1, wherein said housing includes a furcated distal end defining a plurality of forks receivable into said bore, said plurality of forks movable between said collapsed orientation and said expanded orientation.

3. The anchor of claim 1, wherein said biasing means includes a compression spring.

4. The anchor of claim 1, wherein said anchor assembly is movable between said collapsed orientation and said expanded orientation upon application of axial force applied to said anchor assembly in one or more predetermined directions.

5. A rock climbing anchor detachably engagable to a sidewall of a bore extending inwardly through a rock face, said rock climbing anchor comprising:

an anchor assembly including:

a housing movable between a collapsed orientation and an expanded orientation, a stopper carried by said housing and having an expansion element movable between an extended position disposing said housing in said collapsed orientation and a retracted position disposing said housing in said expanded orientation, and biasing means carried by said stopper intermediate a proximal end of said housing and a proximal end of said stopper for biasing said expansion element to said retracted position;

a hanger depending from said anchor assembly terminating with a boxed end engagable by one or more selected climbing accessories;

said rock climbing anchor receivable into a bore in said collapsed orientation and detachably engagable to a sidewall of said bore in said expanded orientation; and a detaching member carried by said housing, said detaching member including a body having a grip that with said anchor assembly engaged with said sidewall of said bore in said expanded orientation, said body of said detaching member adapted to abut said rock face and supports said grip at a location adapted to be spaced from said rock face, wherein said grip is capable of being grasped and moved away from said rock face in response to an external force to release said housing from said expansion element of said stopper disposing said housing in said collapsed orientation detaching said housing from said bore.

6. The rock climbing anchor of claim 5, wherein said housing includes furcated distal end defining a plurality of forks receivable into said bore extending through said face, said plurality of forks movable between said collapsed orientation and said expanded orientation.

7. The rock climbing anchor of claim 5, wherein said biasing means includes a compression spring.

8. The anchor of claim 5, wherein said housing is movable between said collapsed orientation and said expanded orientation upon application of axial force applied to said stopper in one or more predetermined directions.

9. The anchor of claim 5, wherein said housing is movable between said collapsed orientation and said expanded orientation upon application of axial force applied to said housing in one or more predetermined directions.

* * * * *